US005614028A

United States Patent [19]

Rodzewich

[11] Patent Number: 5,614,028

[45] Date of Patent: Mar. 25, 1997

[54] METHOD OF CLEANING AND PASSIVATING A METAL SURFACE WITH ACIDIC SYSTEM AND ETHOXYLATED TERTIARY DODECYL MERCAPTAN

[75] Inventor: Edward A. Rodzewich, Flourtown, Pa.

[73] Assignee: BetzDearborn Inc., Trevose, Pa.

[21] Appl. No.: 454,911

[22] Filed: May 31, 1995

Related U.S. Application Data

[63] Continuation-in-part of Ser. No. 32,081, Mar. 17, 1993, abandoned.

[51] Int. Cl.[6] ..... C23G 1/04; C23C 22/06

[52] U.S. Cl. ..... 134/2; 134/3; 134/41; 148/271; 422/12; 510/261

[58] Field of Search ..... 134/2, 3, 27, 28, 134/29, 41; 252/395, 396, 80; 510/261; 422/12; 148/271

[56] References Cited

U.S. PATENT DOCUMENTS

| | | | |
|---|---|---|---|
| 3,852,213 | 12/1974 | Cooney | 252/181 |
| 3,853,638 | 12/1974 | Wilpers | 148/29 |
| 3,932,296 | 1/1976 | Byth | 252/148 |
| 3,973,998 | 8/1976 | Datta et al. | 106/74 X |
| 4,557,838 | 12/1985 | Nichols et al. | 252/8.55 C |
| 4,670,163 | 6/1987 | Lindstrom et al. | 252/8.555 |
| 4,670,186 | 6/1987 | Quinlan | 252/392 |

*Primary Examiner*—Jill Warden
*Assistant Examiner*—Saeed Chaudhry
*Attorney, Agent, or Firm*—Alexander D. Ricci; Steven D. Boyd

[57] ABSTRACT

An acid based cleaning and passivating treatment for metal surfaces is provided. The single step acid based cleaning and passivating is provided by incorporating a corrosion inhibiting amount of an ethoxylated tertiary dodecyl mercaptan into an acidic metal cleaner.

6 Claims, No Drawings

METHOD OF CLEANING AND PASSIVATING A METAL SURFACE WITH ACIDIC SYSTEM AND ETHOXYLATED TERTIARY DODECYL MERCAPTAN

This application is a continuation-in-part of application Ser. No. 08/032,081 filed Mar. 17, 1993, now abandoned.

FIELD OF THE INVENTION

The present invention relates to the treatment of metal surfaces. Specifically, this invention protects these metal surfaces from the corrosive effects of acid cleaners by incorporating a corrosion inhibitor into an acid cleaner.

BACKGROUND OF THE INVENTION

The problem of corrosion of metal surfaces in contact with various corrosive materials is well known. Most acidic liquids or compositions comprising same will cause corrosion when in contact with metals. The extent of such corrosion will, of course, depend to a large extent on the system on or in which the acidic material is to be used or upon the environmental conditions of such use.

In the area of coating metals, a clean surface is a prerequisite to a quality coating. Grease, metal oxides, including scale, shop dirt, will adversely affect the adhesion, continuity and permanence of the coating by acting as a physical barrier which prevents proper bonding of the coating to the metal.

Metal surfaces can be cleaned by solvent, solvent emulsion, alkaline cleaners, solvent vapor degreasing, or abrasive blasting. Conventional cleaners will not remove scale and oxides from metals. Thus, it is necessary sometimes to use an acid cleaning treatment (pickling) to remove rust and other corrosion products. However, the acids generally used are corrosive and must be rinsed from the surface once it has been cleaned (see U.S. Pat. No. 3,973,998).

The need exists, therefore, to inhibit the corrosive effects caused by these acid cleaners. Conventional corrosion inhibitors which can be incorporated into an acid cleaner include compounds such as thiourea, propargyl alcohol, toluidene, triphenylsulphonium chloride, pyridine and hydroxyalkylthiosubstituted polycarboxylic acids (U.S. Pat. No. 4,670,163). The drawbacks many of these corrosion inhibitors exhibit are that they may be either toxic, flammable, carcinogenic, non-biodegradable or harmful to aquatic life.

Accordingly, an object of this invention is to provide a composition which can be applied to metal surfaces to inhibit corrosion and pitting of the metal without the attendant deleterious side effects of conventional corrosion inhibitors.

DESCRIPTION OF THE INVENTION

The corrosion inhibitor of the present invention is a sulphur containing polyalkyene oxide. The preferred inhibitor is Burco TME, an ethoxylated tertiary dodecyl mercaptan available from Burlington Chemical Company. It may be added to any system in which acidic cleaners or pickling agents are present. The corrosion inhibitor of this invention functions to prevent overpickling or excessive acid attack on the metallic surfaces being treated by this acidic system. It is non-toxic, non-flammable, noncarcinogenic and is not regarded as being harmful to aquatic life.

The acids used to clean or pickle metal surfaces are many and varied. The most commonly used ones are phosphoric acid and sulfuric acid. However, other acids may be used. These include muriatic, citric, glacial acetic, hydrofluoric, formic, oxalic, sulfamic and tartaric. Of course, blends of any of these acids may also be employed. These acids are generally first diluted in an aqueous solution.

The amount of corrosion inhibitor necessary to achieve its corrosion inhibiting objective will depend on the nature of the metal treatment process in which it is employed. In a pickling process, the goal of the acid cleaners is to remove residue and rust on the surfaces of metal components. These components are then passed on to other industrial operations for further processing of the component. It is necessary that the surface of the component have a bright finish, that is, free from rust, residue or corrosion. Frequently, the acid cleaners may remove too much of the metal and cause "overpickling" which then results in an undesirable tarnished surface finish. Under these conditions only a relatively small amount of corrosion inhibitor is required, along the order of 0.001 to 2.0 percent based on the weight of the acid used for pickling. Under most conditions, however, from about 0.05 to 0.5 weight percent is sufficient. A chemical cleaning operation will require more of the corrosion inhibitor of the present invention to be added to the acidic cleaning system. In a chemical cleaning operation, acid is used to remove deposits, such as scale, in working industrial equipment such as boiler tubes. In these instances, it is essential that the acid only attack the deposits and not the underlying metal. Therefore, more corrosion inhibitor is required. The approximate dosage range is about 1.0 to 6.0 percent, based on the weight of the acid in the chemical cleaning system. More typically, the dosage range is from 2.0 to 5.0 weight percent.

In the practice of this invention, the acid will be added to the water system to be used to treat the metal surfaces. The corrosion inhibitor of the invention is added directly to the water system substantially simultaneously with the addition of the acid. If the water system is a bath used for batch type cleaning of components, the acid cleaner and the corrosion inhibitor should be shot fed. If the system is a continuous process, such as may be found in pickling operations, the corrosion inhibitor may need to be fed on a substantially continuous basis. Such a feed strategy encompasses the addition of the corrosion inhibitor on a periodic timed intermittent basis or the continuous flow into the water system by metering means.

The following experimental procedure and example illustrate the present invention.

Experimental Procedure

Two parameters were used to evaluate the efficacy of the corrosion inhibitor:

- weight loss or inhibitor strength as determined by percent protection.
- cleaning efficacy as determined by rust removed and the appearance of the treated metal surface.

Percent protection was determined by immersing 1010 cold rolled steel in a 20% (by volume) solution of an acid cleaner for 30 minutes at 160° F. Tests were first conducted where the ferrous iron level in the water was zero and then with a 5% ferrous iron level to simulate an aged bath. Tests were conducted both without (control) and with the corrosion inhibitor of the present invention. A comparison test was also run which incorporated a wetting agent into the acid cleaner system.

The following formula was used to calculate the percent protection:

$$\% \text{ Protection} = \frac{\text{wt. loss (control)} - \text{wt. loss (inhibited)}}{\text{wt. loss (control)}} \times 100$$

Standard test coupons (½"×2 11/16") were weighed both before and after immersion to determine the weight loss.

The cleaning efficacy was determined by spray cleaning rusted metal sheets with a 20% solution, by volume, of an acid cleaner. The solution contained 0.03% Burco TME, based on the weight of the acid. Spraying was conducted for 5 minutes at 150° +5° F. and then the sheets are rinsed with water for 30 seconds at ambient temperatures. The appearance of the surface was observed for metal discoloration, smut formation and pitting.

An aqueous acid cleaner solution was prepared containing 24.5% sulfuric acid and 22.5% phosphoric acid. The control contained no corrosion inhibitor. An inhibited solution was then prepared by adding 0.03% Burco TME, based on the total weight of the acid. A comparison solution was prepared by adding 0.5% surfonic N-95 (an alkyl phenoxypoly-(ethoxyleneoxy) ethanol available from Texaco Chemical Corp. ) based on the total weight of the acid. Each solution was then diluted to 20% with water and testing was conducted to determine percent protection and cleaning efficacy.

The following table shows the results of the percent protection analysis.

TABLE I

| Acid Solution | Percent Protection 0% Ferrous Iron Content | 5% Ferrous Iron Content |
|---|---|---|
| Control | 0% | 0% |
| Inhibited | 94% | 96% |
| Comparison | 0% | 0% |

The cleaning efficacy of the acid cleaning formulation containing the sulphur containing polyalkylene oxide inhibitor of the present invention was excellent. Not only was the rust completely removed from the subject metal sample but the pickled surface was bright, indicating that the corrosive effects of the acid were sufficiently inhibited. Thus, the single step treatment of the present invention provided acid type cleaning of the metal surface while inhibiting later corrosion of the cleaned surface.

What I claim is:

1. A method of cleaning and passivating a metal surface in a single step comprising contacting a metal surface to be cleaned and passivated with a solution consisting essentially of an acidic cleaning system to which has been added a corrosion inhibiting amount of ethoxylated tertiary dodecyl mercaptan.

2. The method of claim 1 wherein the acidic cleaning system is an aqueous solution.

3. The method of claim 1 wherein the acidic cleaning system comprises at least one acid selected from the group consisting of phosphoric, sulfuric, muriatic, citric, glacial acetic, hydrofluoric, formic, oxalic, sulfamic and tartaric.

4. The method of claim 3 wherein the acidic cleaning system contains phosphoric and sulfuric acids.

5. The method of claim 1 wherein the corrosion inhibiting amount is from about 0.01 to 5 percent, based on the weight of the acid.

6. The method of claim 5 wherein the corrosion inhibiting amount is from about 0.05 to 2 percent, based on the weight of the acid.

* * * * *